United States Patent [19]

Bray

[11] 4,298,068

[45] Nov. 3, 1981

[54] HEAT SENSITIVE RELEASE DEVICES

[75] Inventor: Geddes A. Bray, Moston, England

[73] Assignee: Mather & Platt Limited, Manchester, England

[21] Appl. No.: 970,053

[22] Filed: Dec. 15, 1978

Related U.S. Application Data

[62] Division of Ser. No. 776,057, Mar. 9, 1977, abandoned.

[30] Foreign Application Priority Data

Mar. 12, 1976 [GB] United Kingdom ..... 9915/76

[51] Int. Cl.[3] ..... A62C 37/08

[52] U.S. Cl. ..... 169/39; 169/57

[58] Field of Search ..... 169/37, 38, 39, 42, 169/40, 57

[56] References Cited

U.S. PATENT DOCUMENTS

| | | | |
|---|---|---|---|
| 3,161,236 | 12/1964 | Macartney | 169/39 |
| 3,583,492 | 6/1971 | Vorkapich | 169/39 |
| 3,770,063 | 11/1973 | Juliano | 169/39 |
| 4,029,150 | 6/1977 | Goodsell, Jr. | 169/39 |

*Primary Examiner*—Robert J. Spar
*Assistant Examiner*—Kenneth Noland
*Attorney, Agent, or Firm*—Sughrue, Mion, Zinn, Macpeak and Seas

[57] ABSTRACT

A heat sensitive release device, for example a sprinkler, comprises two relatively movable components, for example a yoke and valve member. A collapsible strut system is located between the relatively movable components. The collapsible strut system includes a catch element having opposed wings between which is held a heat sensitive element, for example a double ended heat sensitive cartridge. The collapsible strut system also includes a lever fulcrummed on one of the components and a strut engaged between the other component and the lever adjacent the fulcrum. The lever bears against the heat sensitive element while the strut is connected to or integral with the catch element. In addition, an impediment is joined to the strut system and disposed between the lever and the catch element so that removal of the heat sensitive cartridge from the catch element is prevented.

7 Claims, 5 Drawing Figures

HEAT SENSITIVE RELEASE DEVICES

This application is a divisional of U.S. Patent Application Ser. No. 776,057 filed Mar. 9th, 1977 now abandoned, and relates to a heat sensitive release device for example, an automatic sprinkler for deluge fire fighting equipment, a heat detector, a multiple spray control valve, or a fusible link.

According to the present invention there is provided a heat sensitive release device comprising first and second relatively movable components, and a normally stable strut system located between the components to retain them in fixed positions relative to each other but collapsible on attainment of a predetermined temperature, the strut system comprising:

(1) a heat sensitive element;

(ii) a catch element having opposed wings between which the heat sensitive element is retained;

(iii) a lever fulcrummed on the first component and bearing against the heat sensitive element;

(iv) a strut engaging at one end on the lever adjacent the fulcrum and at its other end on the second component and joined to the catch element to retain the lever and thereby the strut system in a stable condition;

(v) an impediment joined to the strut system and disposed between the lever and the strut to prevent lever movement towards the strut and removal of the heat sensitive element from the catch element, whereby on attainment of the predetermined temperature the heat sensitive element disengages from the wings of the catch element and permits the lever to pivot about the fulcrum to disengage the strut from the second component which together with the first component are both freed for relative movement.

It is considered that this heat sensitive release device provides the following advantages:

1. The manufacturing tolerances of the components of the heat sensitive element do not have to relate in a critical manner to the working tolerances of the length or other dimensions and angles of the members of the collapsible strut system, or vice versa, but only to the distances between the wings of the catch element.

2. The load on the heat sensitive element is halved for a particular design of collapsible strut system as compared with existing systems.

This being so, the dimensions of the heat sensitive element can be reduced for reasons of cost, convenience and appearance, or more importantly the collapsible strut system may be shortened to reduce the size of the release device.

3. An impediment is provided between the lever and the strut to prevent lever movement towards the strut and removal of the heat sensitive element from the catch element.

The provision of an impediment to prevent cartridge removal from the catch element is desirable to making the components of the collapsible strut system rigid. A degree of springiness in the components of the strut system is desirable as this enables them to fly apart easily when the cartridge is released from the catch element.

Embodiments of the present invention will now be described by way of example with reference to the accompanying drawings, in which.

Figure 1:
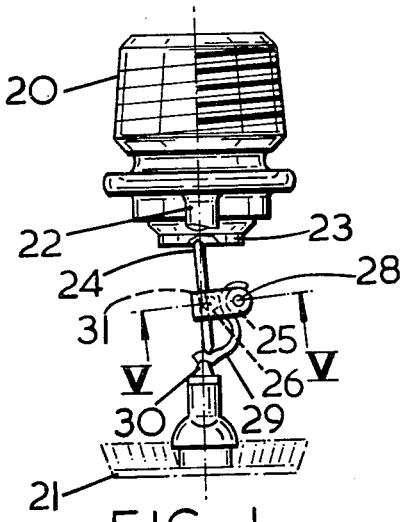
FIG. 1 is a side elevation view of an automatic sprinkler with yoke partially removed and incorporating a collapsible strut system according to the present invention.

Referring to FIG. 1, the heat sensitive release device comprises a tubular body 20 for screw-engagement in pipework, a deflector 21 axially spaced from the tubular body 20 and connected thereto by a yoke 22 (shown partially broken away). A through-flow passage traverses the tubular body 20 and is normally closed by a valve 23. The valve 23 is maintained closed by a strut 24 which forms part of a collapsible strut system which collapses when a predetermined temperature is obtained, thus permitting valve opening and delivery of a fire quenching fluid, or gas pressure release when the sprinkler forms part of a fire detection system.

The collapsible strut system additionally comprises a cylindrical heat sensitive cartridge 25, as will be described later, fitted between two wings 26 of a U-shaped catch element 27. The wings 26 of the catch element 27 have concave recesses or holes 28 to accommodate and locate the cartridge 25. As stated, the strut 24 is located at one end in a grove in the valve 23 and at its other end engages in a formation in a lever 29. The lever 29 locates at one end on a fulcrum formed by a pin or screw 30 adjacent the location of the strut 24. However, at its other end, the lever curves around and bears against the cartridge 25 held between the two opposing wings 26 of the U-shaped catch element 27. The catch element 27 passes around the strut 24 and a rivet 31 is fitted across the two opposite portions of the catch element 27 between the strut 24 and the lever 29 drawing the portions together to a specific dimension. In addition the rivet 31 acts as an impediment to prevent the cartridge 25 from being removed from the catch element 27 by preventing the lever 29 from being pushed away from the cartridge 25.

Figure 2:
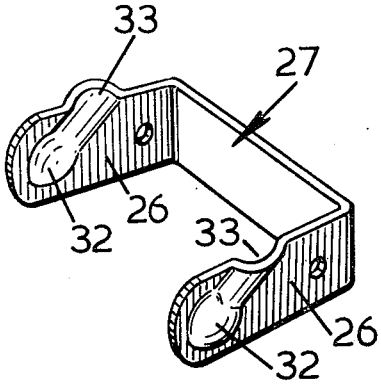
FIG. 2 is a perspective view to an enlarged scale, of a modified catch element of the collapsible strut system.

The catch element 27, as described, can be modified. As shown in FIG. 2 the catch element 27 is formed from a single piece of metal suitably bent to a U-shape to provide the opposed wings 26, each of which is pressed to form recesses 32 centrally of the wings 26 and lead-in channels 33. The lead-in channels 33 facilitate positioning of the cartridge 25. In another modification (not shown), the wings 26 can be made shorter so that the connecting portion between the wings 26 lies adjacent the lever 29 where it curves around the cartridge 25. A tab is bent outwards at an angle from the connecting portion of the catch element 27 and apertured to allow the strut 24 to pass therethrough and thereby retain the catch element 27. Alternatively, tags could be attached to the wings 26 and bent around the strut 24 to retain the catch element 27.

Figure 3:
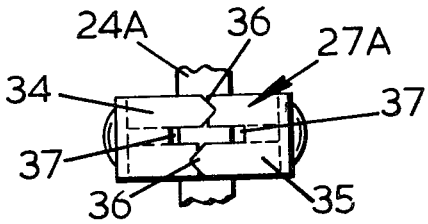
FIG. 3 shows a modified catch construction.

A further modification is shown in FIG. 3. In this case the catch element 27A is of two part construction 34 and 35. The two parts 34 and 35 have complementarily-shaped edges indicated at 36 to ensure correct relative positioning and they are secured together by, inter alia, a rivet, or screw and nut, or a pin and spring push-on self locking retaining rings. The two interconnected parts 34, 35 thus define a slot between the securement and the catch ends through which the strut 24A can pass as shown. Tags 37 are formed on the catch element 27A and lie close to the strut 24A at each side thereof for location purposes.

In yet a further modification, the cartridge can be held between two opposing wings which may form part of or may be attached to a sprinkler valve or to a fixed part of a sprinkler, for example the wings could form part of the yoke of the sprinkler. As described, the lever would again bear against the cartridge to hold the strut system in a non-collapsed condition and the cartridge would be retained by bending over tags on the wing edges. Alternatively, the cartridge could be retained by making an attachment to, or suitable deformation of, the lever end or by pegging or riveting the wings or lever end to provide an obstruction equivalent to a tag or tags.

Figure 4:
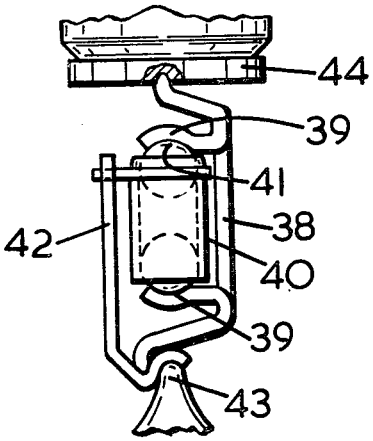
FIG. 4 is a fragmentary side view of a further modified sprinkler.

Another embodiment or sprinkler is shown in FIG. 4 and in this embodiment it will be seen that the heat sensitive element lies substantially along the longitudinal axis of the sprinkler.

A strut 38 is made from a strip of material wide enough to be pierced and for two opposing wings 39 to be punched out therefrom. A heat sensitive cartridge 40 is held between the opposing wings 39, which are recessed as at 41, and one end of a lever 42 bears against the cartridge 40 exerting a sideways force thereon. The other end of the lever 42 locates on a fulcrum 43 of the sprinkler yoke (not shown) and is also shaped to locate one end of the strut 38. The other end of the strut 38 is located in a groove on a valve 44 of the sprinkler.

Figure 5:
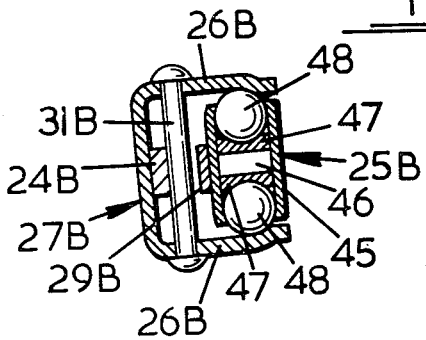
FIG. 5 is a section on the line V—V of FIG. 1.

The cartridge as used in various embodiments of the invention and as shown in cross-section in FIG. 5 as at 25B, comprises a cylindrical tube 45 within which is a fusible pellet 46 and circular discs 47 which act as pressure pads and provide seating for two spheres 48 which protrude from the end of the tube 45. The discs 47 may have spherical segmental indentations, as shown, to reduce the compressive stresses applied to the spheres 48. Also as shown, the spheres 48 may be retained in the cartridge tube 45 by slightly swaging the ends of the tube 45 onto the spheres 48 at a section smaller than a sphere diameter. The pressure pads 47 may be, for example, manufactured of brass and the spheres 48 of glass.

In a modification, the spheres 48 may be replaced by cylindrical plungers having hemi-spherical, conic frustum or chamfered ends.

The cartridge may comprise a blind ended type with only one movable sphere or plunger, the outside of the blind end being configured to conform with the sphere or plunger. However, it is recognised that this latter arrangement is not as satisfactory as the arrangement described since:

(a) It does not increase the chances of the heat sensitive release device operating under adverse conditions which may cause one of the spheres or plungers to stick in the cartridge cylinder.

(b) the cartridge must be manufactured in its depth and outside length to accurate limits, which is not the case with the alternative arrangement where the cartridge tube merely contains elements which either correspond to those used with the blind tube or are easy to control dimensionally such as strip material for pressure pads and such as spheres.

The spaces around the spheres 48 and between the cartridge ends of the wings 26B may be protected from corrosion in a conventional manner by the spheres 48 being immersed in or surrounded by a fusible compound of lower melting point than the pellet 46 such as petroleum jelly, wax or mixtures of these, bitumen, greases etc.

In a modification, a projection may be provided on the central portion of the strut to prevent uneven contact between the cartridge and the lever, which projection also provides an impediment to prevent removal of the cartridge 25B from the catch 27B.

While the embodiments of heat sensitive release device of the present invention have been described above as being automatic firefighting or detector sprinkler, they may be, alternatively, multiple spray control valves, having simple or compound link systems, fusible link systems (simple or compound) or any other appliance where there is use for such a device, and the scope of the invention disclosed and claimed herein is to be construed accordingly.

In all the embodiments so far described, a heat sensitive cartridge is used to provide an element sensitive to a predetermined temperature above which collapse of the strut system is required. When the predetermined temperature is attained, the fusible pellet within the cartridge melts permitting the sphere or spheres to move inwardly of the cartridge tube. The lever of the collapsible strut system which bears against the cartridge is thereby released so that the strut system collapses, for example, to open a valve of a sprinkler.

However, it will be realised that many other types of heat sensitive element could be used in the embodiments of the invention described in place of the cartridge. For example, a strip of a heat sensitive metal alloy could be used, in any of the collapsible strut systems described. Such a strip would convert heat energy supplied to it to mechanical energy and thereby change its shape to a predetermined shape. Metal alloys suitable for this purpose comprise nickel-titanium alloys known as 55-Nitinol alloys which are heat treated so as to return to a predetermined shape on subsequent heating.

Thus it will be realised that various heat sensitive elements can be used in place of the cartridge element described above with reference to the drawings.

It is also envisaged in the embodiments of heat sensitive release device described that the lever could be a spring lever which provides more rapid separation of the components of the collapsible strut system.

Alternatively, flexibility may be provided in the collapsible strut system by positioning spring washers (Belville washers) in, for example, a sprinkler assembly, or in a half link, or by fitting a compression spring in the yoke, valve, half link system or control lever depending into which article the heat sensitive release device is incorporated. The spring action may alternatively be provided by manufacturing the sprinkler yoke of flexible material, or by so shaping it as a beam to give greater than normal flexibility. This may similarly be achieved by suitable design of the half links of a fusible link, or by suitable design of the lever and/or yoke of a control valve. A further advantage of providing flexibility in the strut system is to reduce variation in the load transmitted to the cartridge so that creep of the fusible pellet will not be caused by over-loading resulting from dimensional errors.

The heat sensitive release device of whatever construction may, if desired, be triggered electrically. For this purpose a flange may be formed on the cartridge body and a one-shot actuator disposed in close proximity thereto so that, on operation of the latter, the flange is struck causing the components of the collapsible strut system to fly apart. The actuator, in the case of a sprinkler for example, may be mounted on the yoke adjacent the cartridge.

What is claimed is:

1. A heat sensitive release device comprising first and second relatively movable components, and a normally stable strut system located between the components to retain them in fixed positions relative to each other but collapsible on attainment of a predetermined temperature, the strut system comprising:

(i) a heat sensitive element;

(ii) a catch element having opposed wings between which the heat sensitive element is retained;

(iii) a lever fulcrummed on the first component and bearing against the heat sensitive element;

(iv) a strut engaging at one end the lever adjacent the fulcrum and at its other end the second component and joined to the catch element to retain the lever and thereby the strut system in a stable condition;

(v) an impediment joined to the strut system and disposed between the lever and the strut to prevent lever movement towards the strut and removal of the heat sensitive element from the catch element said impediment being attached to the catch element, whereby on attainment of the predetermined temperature the heat sensitive element disengages from the wings of the catch element and permits the lever to pivot about the fulcrum to disengage the strut from the second component which together with the first component are both freed for relative movement.

2. A heat sensitive release device as claimed in claim 1, in which the impediment is directed towards the lever.

3. A heat sensitive release device as claimed in claim 1 or 2 in the form of an automatic sprinkler and in which one of the first and second components is a movable valve member of the sprinkler while the other is a yoke of the sprinkler.

4. A sprinkler as claimed in claim 3, in which a deflector is joined to the yoke of the sprinkler.

5. A sprinkler as claimed in claim 3 in which the catch element is substantially U-shaped, whereof the wings are formed with locating formations for receiving the ends of the heat sensitive element.

6. A sprinkler as claimed in claim 1, in which the strut is integral with the catch element and is configured to provide the opposed wings between which the heat sensitive element is retained.

7. A sprinkler as claimed in claim 1, in which the catch element is of two part construction and defines a slot through which the strut passes.

* * * * *